US006599139B1

(12) United States Patent
Hunter

(10) Patent No.: US 6,599,139 B1
(45) Date of Patent: Jul. 29, 2003

(54) TIMER CONNECT-DISCONNECT FOR TELEPHONE, CABLE AND NETWORK CONNECTIONS

(76) Inventor: Michael J. Hunter, 200 Shawnee, Tioga, TX (US) 76271

( * ) Notice: Subject to any disclaimer, the term of this patent is extended or adjusted under 35 U.S.C. 154(b) by 2 days.

(21) Appl. No.: 10/059,485

(22) Filed: Jan. 29, 2002

(51) Int. Cl.[7] ..... H01R 25/00

(52) U.S. Cl. ..... 439/133; 439/638; 439/640; 439/135

(58) Field of Search ..... 439/638, 639, 439/640, 133, 135; 200/33–38

(56) References Cited

U.S. PATENT DOCUMENTS 5,686,881 A * 11/1997 Ridout ..... 340/332
6,329,616 B1 * 12/2001 Lee ..... 200/51.03
6,429,779 B1 * 8/2002 Petrillo et al. ..... 340/644
6,442,106 B1 * 8/2002 Newby et al. ..... 368/4

* cited by examiner

*Primary Examiner*—P. Austin Bradley
*Assistant Examiner*—Truc Nguyen
(74) *Attorney, Agent, or Firm*—John E. Vandigriff

(57) ABSTRACT

A secure programable timer allows connections to the internet via a phone line or a network during a programmed specific time range. A timer is set to close the connection from a computer (or telephone) to the phone line or network during a programmed time span. The computer is not connected to the phone line or network outside of the programmed time span. A timer motor rotates a timer that has programmable devices that interact with a gear to close the connection between the computer and the phone/network line during the programmed time, and to open the connection at time not in the programmed time range. A cover is secured over the timer and connection to the phone/network line to prevent a bypass connection to the phone/network line.

15 Claims, 6 Drawing Sheets

TIMER CONNECT-DISCONNECT FOR TELEPHONE, CABLE AND NETWORK CONNECTIONS

FIELD OF THE INVENTION

The invention relates to a programmable timer and circuits connected thereto, and more particularly to a protected timer and connect-disconnect circuit for Telephone, Cable and Network Connections.

BACKGROUND OF THE INVENTION

A computer may be connected to the internet through a dial-up telephone line, a cable connection or a network. When the connection is through a dial-up connection, the computer is connected through a telephone line. This line usually is connected by a telephone cord connected to an outlet in the wall and a connection to the computer through a modem. In this instant, the cord commonly uses RJ11 plugs. When the connection is made through a cable modem or network, the cord commonly uses RJ45 plugs. In either circumstance, the cord is commonly connected between the computer and a wall outlet that is wired in to the house telephone or network lines.

Children often have a telephone connection is their room, and tend to stay on the internet late into the night, or to make telephone calls after the time they should be asleep in bed. It is desirable to have control over the telephone and internet connection so that the use is not abused by extending it late into the night.

SUMMARY OF THE INVENTION

The invention is a secure programable timer for allowing connections to the internet via a phone line or a network during a programmed specific time range. A timer is set to close the connection from a computer to the phone line or network during a programmed time span. The computer, or a telephone, is not connected to the phone line or network outside of the programmed time span. A timer motor rotates a timer that has programmable devices that interact with a gear to close the connection between the computer and the phone/network line during the programmed time, and to open the connection at times not in the programmed time range. A cover is secured over the timer and connection to the phone/network line to prevent a bypass connection to the phone/network line.

BRIEF DESCRIPTIONS OF THE DRAWINGS

DESCRIPTION OF A PREFERRED EMBODIMENT

Figure 1:
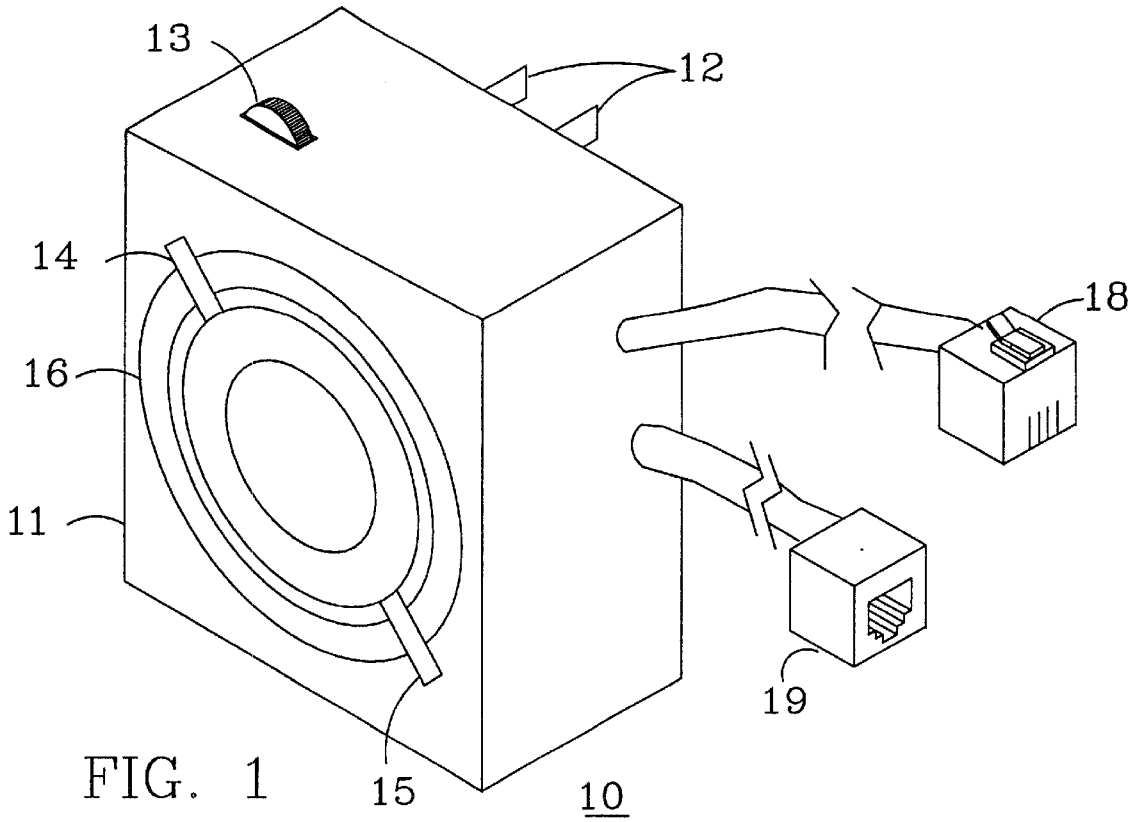
FIG. 1 shows a connect/disconnect switch of the invention.

FIG. 1 shows an example of a timer switch 10 for connecting and disconnecting a telephone or network line from, for example, a computer to a telephone or internet connection Switch 10 has a housing 11 which houses a motor driven timer 16. Timer 16 is programed by two programming devices 14 and 15 which are manually placed on timer 16 to program the "ON" and "OFF" time of the switch. A power On/OFF switch 13 is shown in the top of housing 11, and power is supplied to the timer motor by prongs 12 which are plugged into a power outlet. Switch 10 is connected to a telephone or network jack by plug 18, and to the computer by connector 19.

Figure 2:
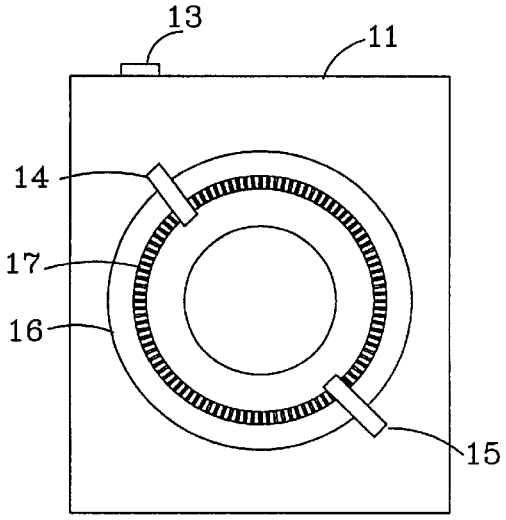
FIG. 2 is a from view of the connect/disconnect switch.

FIG. 2 is a front view of timer switch 10 showing ON/OFF switch 13, timer 16 with the rotating time set ring 17 with programing devices 14 and 15.

Figure 3:
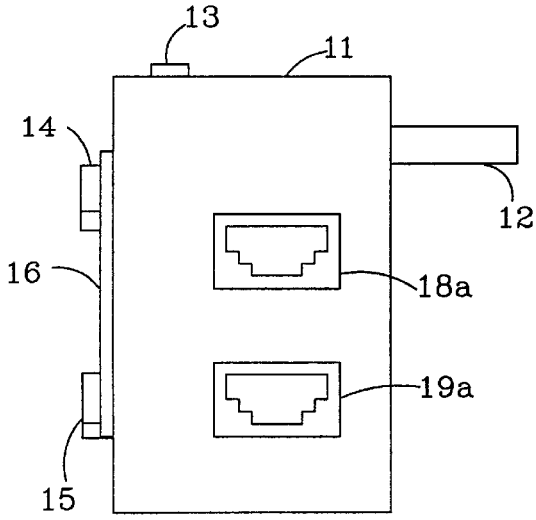
FIG. 3 is a side view of the connect/disconnect switch.

FIG. 3 is a side view of timer 10 showing prong 12 extending out of the back of the timer. Timer 16 is shown on the front side with the time set devices 14 and 15. As an alternative to the plug and jack 18 and 19, jacks 18*a* and 19*a* may be placed in the side of housing 11. In this manner, ordinary telephone or network cables may be plugged into the jacks.

Figure 4:
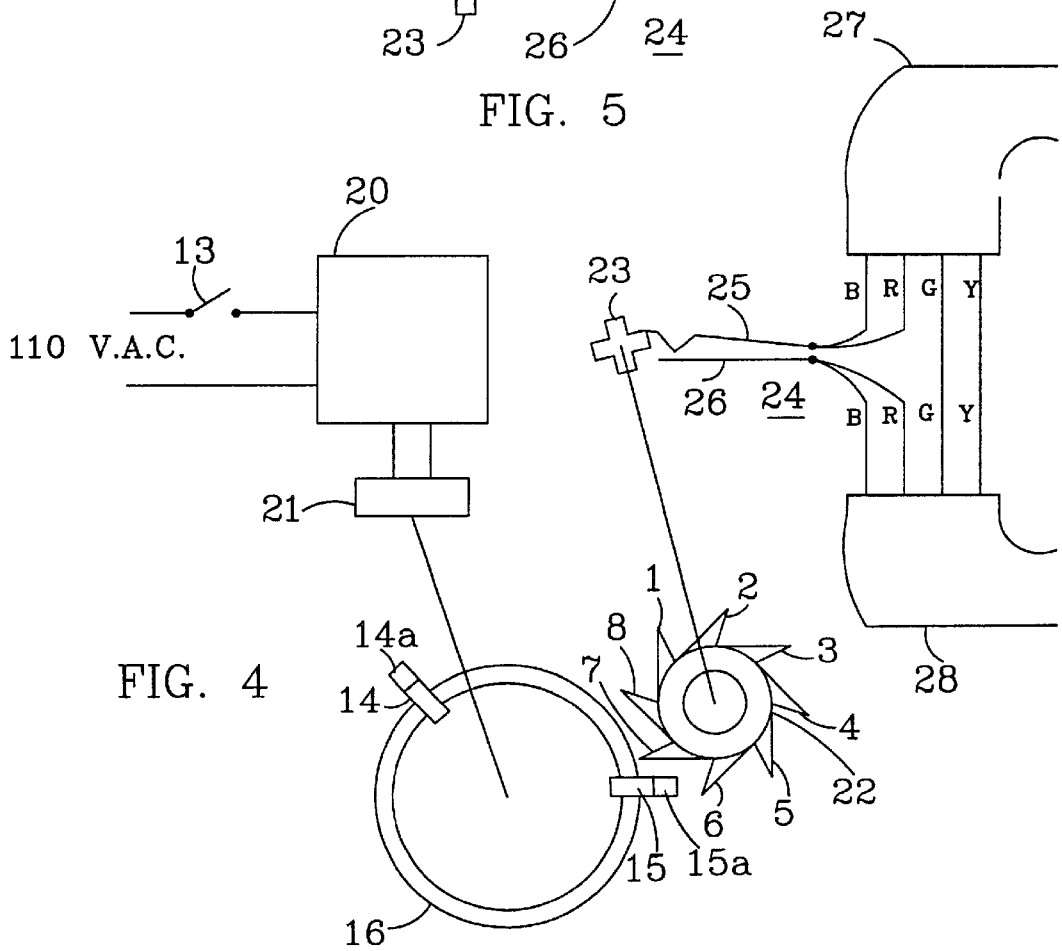
FIG. 4 is a pictorial illustration of the function of the connect/disconnect switch.

FIG. 4 is a pictorial illustration of the operation of the timer and switch to connect and disconnect the phone/network cable. A timer motor 20 is powered from a 110 volt A.C. outlet. A gear 21 is driven by timer motor 20 which in turn is connected to timer 16 and timer set ring 17. Programing devices 14 and 15 are moveably attached to timer set ring 17 at specific times when connect/disconnect switch 25 is to be open or closed.

Programing devices 14 and 15, as timer 16 rotates, engage wheel 22 which has teeth 1–8 extending outward from wheel 22. The eight teeth on wheel 22 are alternately position in a "high" or "low" position so that programing timing device 14 will only engage the low, or odd numbered (1,3,5,7) teeth, and programing timing device 15 will only engage the even numbered (2,4,6,8) teeth.

Figure 5:
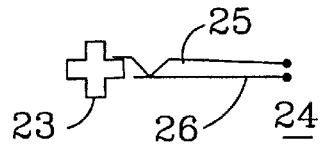
FIG. 5 show a switch "ON/OFF" switch in the "ON" position.

When a tooth on wheel 22 is engaged by either programing timing device 14 or 15, wheel 22 is rotated through a small angle rotating gear 23. The rotation of gear 23 is sufficient to open or close switch 24 by moving switch arm 25 into or out of engagement with switch arm 26. FIG. 4 shows switch 24 open, and FIG. 5 shows switch 24 closed.

Cable 27 is, for example, the telephone or network line into the timer switch, and cable 28 is the telephone or network line connected to the computer. Each cable 27,28 has at least four conductors labeled B(black), R (red), G (green) and Y (yellow) which are color codes for a standard telephone line. With the four conductors, two telephone lines may be connected to timer switch 10. The B (black) and R (red) conductors for both cable 27 and 28 are connected or disconnected from each other depending on the state of switch 24, open or closed.

In FIG. 4, programing timing device 15 is adjacent to tooth 7 of wheel 22. As programing timing device 15 rotates and engages tooth 7, wheel 22 and gear 23 will be rotated sufficiently to either close or open switch 24, depending upon the condition of switch 24 prior to the rotation of gear 23. Switch 25 will then stay in an open or closed condition until programing time device 14 rotates adjacent to wheel 22 and engages tooth 6 and rotates wheel 22 and gear 23 to change the condition of switch 24 from its prior condition.

Figure 6:
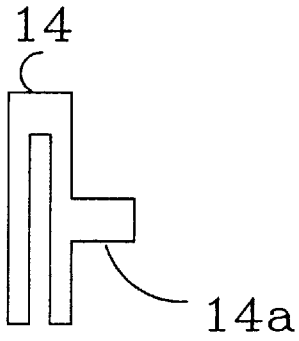
FIG. 6 shows a first program device for activating the "ON/OFF" switch.
Figure 7:
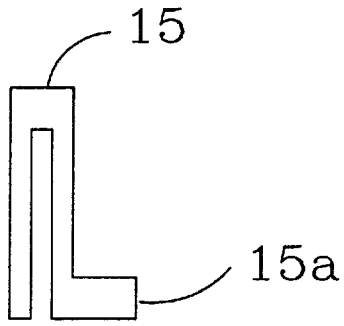
FIG. 7 shows a second program device for activating the "ON/OFF" switch.

FIGS. 6 and 7 show the two programing timing devices 14 and 15. As illustrated in FIG. 4, programing timing device 14 has an extension 14*a* that extends outward that engages teeth 2,4,6,8 and programing timing device has an extension 15*a* that extends outward to engage teeth 1,3,5,7.

Figure 8:
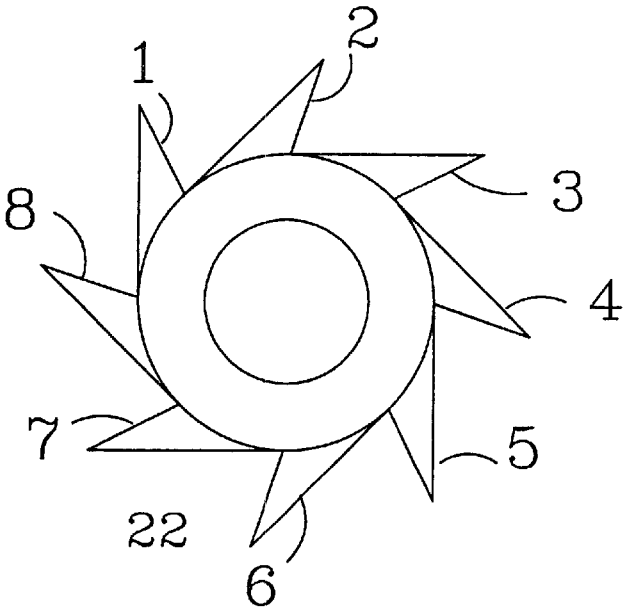
FIG. 8 shows a front view of a switch activating gear.
Figure 9:
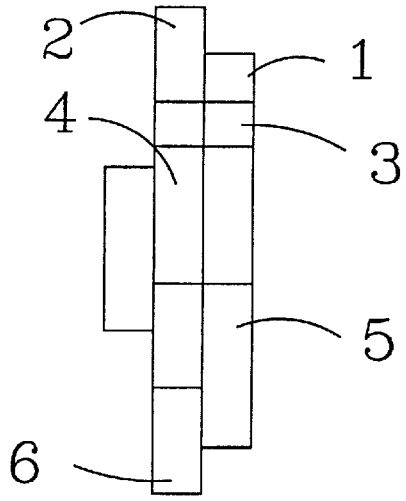
FIG. 9 shows a side view of a switch activating rear.

FIGS. 8 and 9 are front and edge views of wheel 22. FIG. 9 shows that teeth 2–8 (8 not shown) are on one side of wheel 22 and teeth 1–7 (7 not shown) are on another side.

Figure 10:
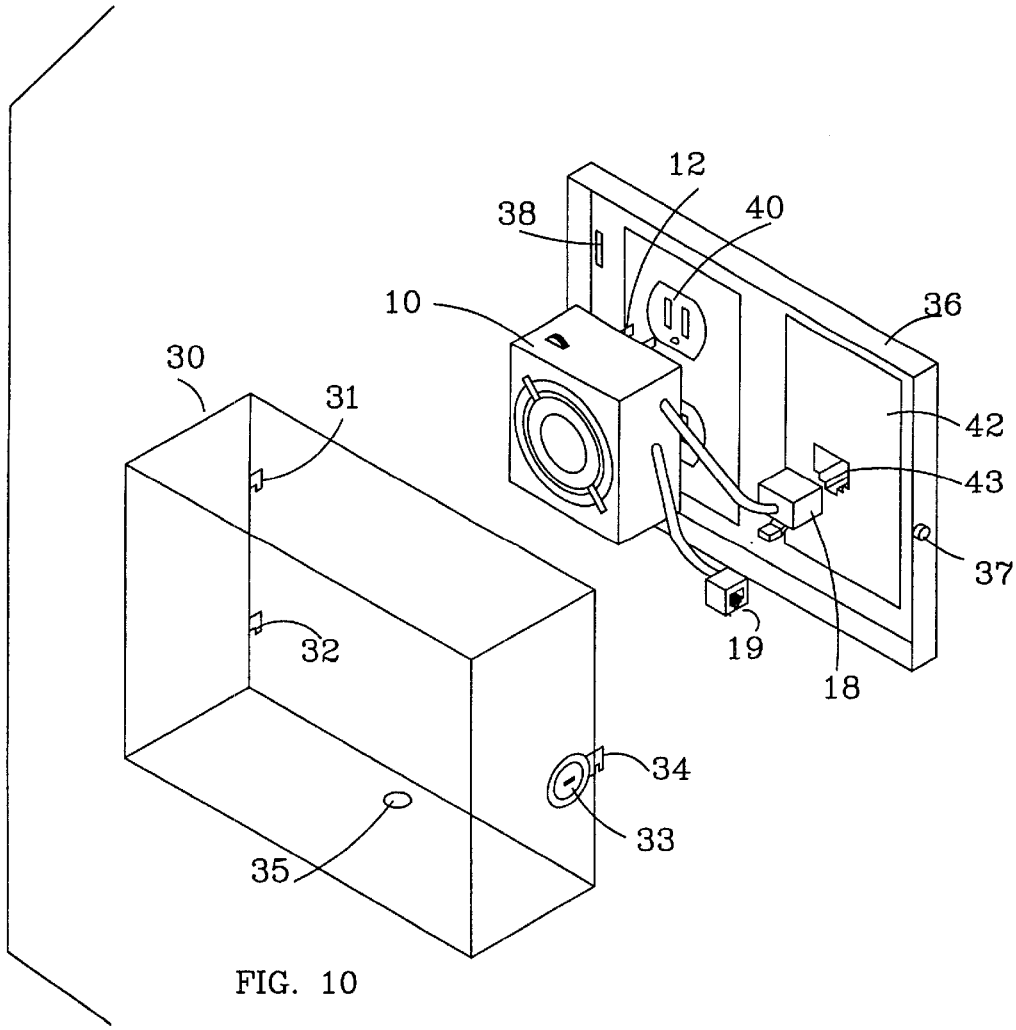
FIG. 10 shows the complete timer and a connect-disconnect circuit for Telephone, Cable and Network Connections of the present invention.

FIG. 10 illustrates the protected timer and connect/disconnect circuit for Telephone, Cable and network connections of the invention. Timer 10 is plunged in to a power plug 40. Connector 18 is plugged into a telephone or network plug 43 in plate 42. The base 36 of protective cover 30 is secured to the wall in which the power outlet 40 and telephone connector 42/43 are mounted. Cover 30 is attached to base 36 by inserting connectors 31 and 32 in to openings 38 (only one shown in FIG. 10) and lock 33 is turned to cause lock arm 34 to engage pin 37. Connector 19 extends through opening 35 so that the computer may be connected to the telephone or network line.

Figure 11:
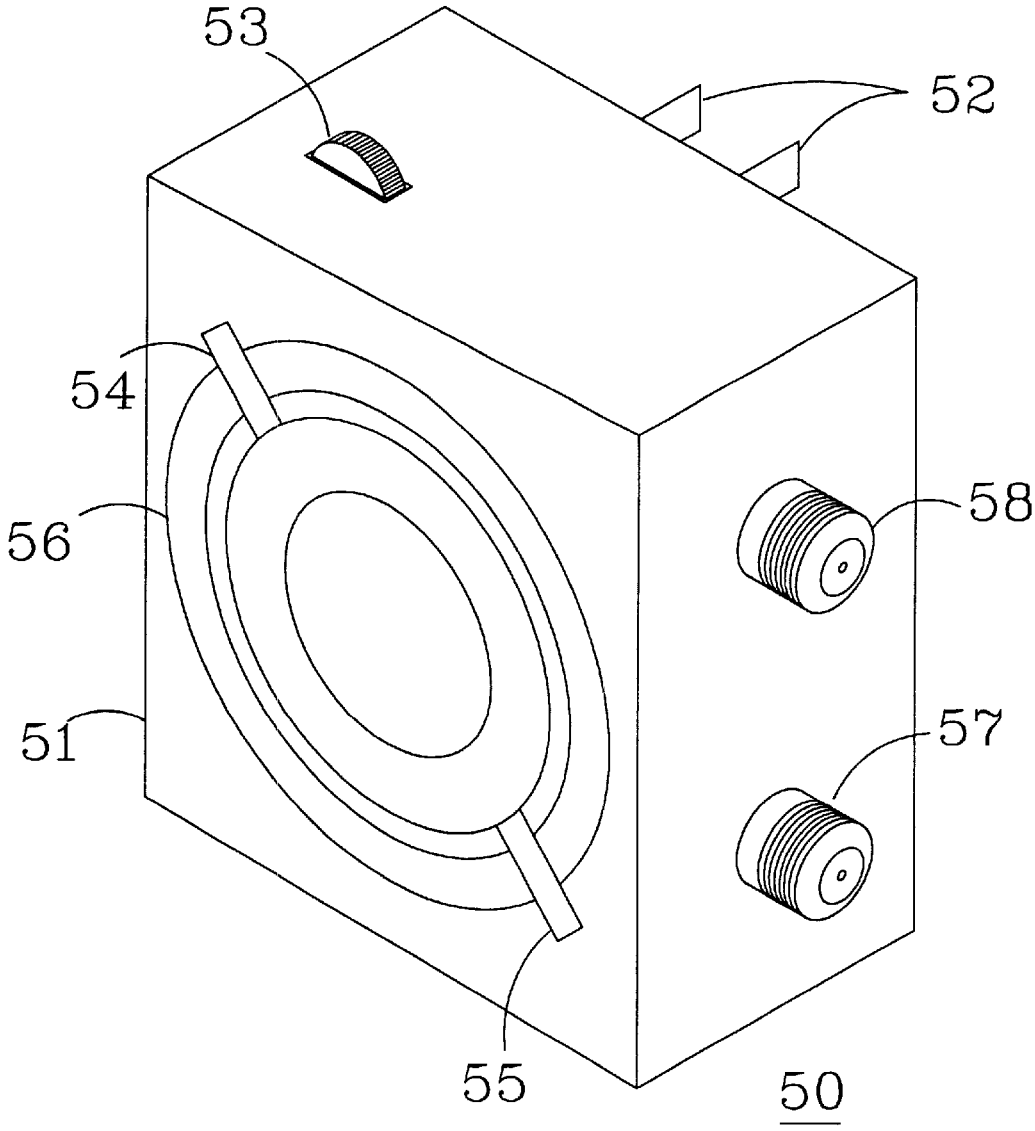
FIG. 11 shows a connect/disconnect switch of the invention configured to use as a cable/tv switch.

FIG. 11 shows an example of a timer switch 50 for connecting and disconnecting a telephone or network line from, for example, a computer to a telephone or internet connection. Switch 50 has a housing 51 which houses a motor driven timer 56. Timer 56 is programed by two programming devices 54 and 55 which are manually placed on timer 16 to program the "ON" and "OFF" time of the switch. A power On/OFF switch 53 is shown in the top of housing 51, and power is supplied to the timer motor by prongs 52 which are plugged into a power outlet. Switch 50 is connected to a cable or TV outlet by connector 57, and to the TV by connector 58. A cover such as cover 30 of FIG. 10 may be placed over timer switch 50 to prevent changing of the ON/OFF time for the TV as set by a parent or other authorized person.

An example of operation of the protected timer and connect/disconnect circuit for Telephone, Cable and Network Connections is a follows. Timer 10 is set to close switch 24 (FIG. 4) at 7:00 AM in the morning and to open switch 24 at 10:00 P.M. at night. During the period 7:00 A.M. to 10:00 P.M. a computer, or telephone, connected to connector 19 may access the internet or a network. At all other times switch 24 is open not allowing access to the internet or network. After timer 10 is programmed to the desired time range, cover 30 is locked into place on base 30 not allowing access to timer 10 so that it cannot be programmed for other than the desired time range.

What is claimed is:

1. A secure timer-connector assembly for a computer connected to a telephone/network connection, comprising:

a first connector and first cable connecting to a telephone/network connection;

a second connector and second cable connecting to a computer;

a time programmable switch connecting said first cable to said second cable for a desired time period; and a lockable enclosure enclosing said time programmable switch, first and second connectors for preventing access to said time programmable switch and telephone/network connection.

2. The secure timer-connector assembly according to claim 1, including programming devices for programming the time programmable switch.

3. The secure timer-connector assembly according to claim 2, wherein said programming devices activate a gear for opening and closing a switch which within said timer-connector assembly.

4. The secure timer-connector assembly according to claim 1, wherein said time programmable switch attaches directly to a power outlet on a wall adjacent to a telephone/network connection, and said enclosure is mounted over the programmable switch and telephone/network connection to limit access thereto.

5. The secure timer-connector assembly according to claim 1, wherein said time programmable switch disconnects at least two conductors connected between said first cable and said second cable.

6. The secure timer-connector assembly according to claim 1, wherein said telephone/network connection is capable of connecting to a plurality computers/telephones, and said timer switch disconnects only the computer which is connected to the telephone/network connection through the timer connect/disconnect switch.

7. The secure timer-connector assembly according to claim 1, wherein a timer connect/disconnect switch is enclosed in a housing, and said housing has connection input and output jacks mounted therein.

8. The secure timer-connector assembly according to claim 1, wherein said time programmable switch plugs directly into a wall power outlet.

9. A secure timer-connector assembly for a computer connected to a telephone/network connection, comprising:

a first connector and first cable connecting to a telephone/network connection;

a second connector and second cable connecting to a computer;

a time programmable switch connecting said first cable to said second cable for a desired time period;

first and second programming devices programming the time programmable switch; and a lockable enclosure enclosing said time programmable switch, first and second connectors for preventing access to said time programmable switch and telephone/network connection.

10. The secure timer-connector assembly according to claim 9, wherein said programming devices activate a gear for opening and closing a switch which within said timer-connector assembly.

11. The secure timer-connector assembly according to claim 9, wherein said programmable switch attaches directly to a power outlet on a wall adjacent to a telephone/network connection, and said enclosure is mounted over the programmable switch and telephone/network connection to limit access thereto.

12. The secure timer-connector assembly according to claim 9, wherein said time programmable switch disconnects at least two conductors connected between said first cable and said second cable.

13. The secure timer-connector assembly according to claim 9, wherein said telephone/network connection is capable of connecting to a plurality computers/telephones, and said timer switch disconnects only the computer which is connected to the telephone/network connection through the timer connect/disconnect switch.

14. The secure timer-connector assembly according to claim 9, wherein a timer connect/disconnect switch is enclosed in a housing, and said housing has connection input and output jacks mounted therein.

15. The secure timer-connector assembly according to claim 9, wherein said time programmable switch plugs directly into a wall power outlet.

* * * * *